US008001658B2

(12) United States Patent
Christian et al.

(10) Patent No.: US 8,001,658 B2
(45) Date of Patent: Aug. 23, 2011

(54) CLASP FOR BAND

(75) Inventors: Martin Christian, Eteaux (FR); Vincent Lemosquet, Bons-en-Chablais (FR)

(73) Assignee: Rolex S.A., Geneva (CH)

( * ) Notice: Subject to any disclaimer, the term of this patent is extended or adjusted under 35 U.S.C. 154(b) by 954 days.

(21) Appl. No.: 11/868,142

(22) Filed: Oct. 5, 2007

(65) Prior Publication Data

US 2008/0083101 A1 Apr. 10, 2008

(30) Foreign Application Priority Data

Oct. 6, 2006 (EP) ..... 06405427

(51) Int. Cl.
*A44C 5/18* (2006.01)

(52) U.S. Cl. ..... 24/71 J; 24/265 WS

(58) Field of Classification Search ..... 24/71 J, 24/265 WS, 265 BC, 265 EC, 70 ST, 68 E, 24/70 J; 224/171, 164, 174, 178, 176, 177
See application file for complete search history.

(56) References Cited

U.S. PATENT DOCUMENTS 1,756,769 A * 4/1930 Tost ..... 24/71 J
2,596,186 A 5/1952 Volk
2,997,761 A * 8/1961 Davis ..... 24/68 R
5,175,912 A * 1/1993 Chevalley et al. ..... 24/68 J
5,771,543 A * 6/1998 Froidevaux et al. ..... 24/71 J
2006/0090305 A1 * 5/2006 Aquillon et al. ..... 24/265 WS

FOREIGN PATENT DOCUMENTS

CH 667 979 A5 5/1952
CH 668 353 A5 12/1988

OTHER PUBLICATIONS

European Search Report No. EP 06 40 5427, dated Dec. 5, 2006.

* cited by examiner

*Primary Examiner* — Robert J Sandy
*Assistant Examiner* — Rowland D Do
(74) *Attorney, Agent, or Firm* — Westerman, Hattori, Daniels & Adrian, LLP

(57) ABSTRACT

A clasp including long hinged arms (1, 2, 13), a mechanism for adjusting the longitudinal position of the connecting member (20) connecting one of the free ends of the band to one of the long arms (1, 2, 13), having two tracks (18) defining two corresponding paths extending in two planes parallel to the longitudinal axis of the arms (1, 2, 13), and sliding elements (19, 39) for engaging with the respective guide tracks (18), the respective cross sections of the tracks and of the sliding elements including complementary adjacent surfaces to limit the movement of the sliding elements (19, 39) to one degree of freedom corresponding to the sliding path of the tracks (18), in such a way as to ensure free translational movement of the connecting member.

23 Claims, 4 Drawing Sheets

CLASP FOR BAND

The present invention relates to a clasp for a band, such as a wristwatch band, comprising at least two long arms that pivot on each other about transverse hinge pins at one of their respective longitudinal ends, a locking device for keeping the free ends of these two long arms in the folded position, connecting members for connecting the long arms to the respective ends of a band, and a mechanism for adjusting the longitudinal position of the connecting member connecting one of the free ends of the band to one of the long arms having on the one hand a sliding device comprising guide elements integral with a first one of the long arms, extending essentially longitudinally to this arm, two stops for defining the active length of said guide elements, sliding elements integral with the connecting member connecting one of the ends of the band to this first long arm, engaged with the guide elements, and on the other hand a positioning device, of which a first part has a plurality of longitudinal positioning elements extending along this first long arm, for a length equal to the distance between the two stops, and of which the second part has an immobilizing element integral with said connecting member, shaped to engage when desired with said plurality of longitudinal positioning elements.

BACKGROUND ART

Among the numerous clasps for bands with length-adjusting devices, a clasp of the type indicated above has already been proposed in CH 668 353. One drawback of the adjustment device used in the clasp described in that document is that the tracks in which the two sliding members are engaged are simple openings passing through the side walls of the clasp cover. Such guide openings are there essentially to limit the amplitude of movement of the connecting member and to define its path, but they cannot guide it to move translationally. To this end, the connecting member is formed by a plate whose lateral edges slide against the side walls of the cover of the clasp. The device is therefore guided by a hybrid system which does not provide great accuracy and does not therefore ensure a smooth non-sticking sliding action.

Another drawback with that invention is that the members designed to change the position of the connecting member are the same members which control the opening and closing of the clasp. This means that there is no way of opening the clasp without changing the position of the connecting member and therefore losing the setting of the length. Clearly, this is a tiresome task for a user, every time the watch is taken off or put back on, as it may be several times in a day. Since furthermore this action is done by pushing towards each other two members which slide along an axis extending transversely relative to the band, and these members project from either side of the clasp, they can be operated unintentionally, even accidentally, which is of course undesirable.

Another clasp of this type is disclosed in JP 2000 279 217. In this clasp the length-adjusting device is independent of the opening and closing device but it does not eliminate the risk of unintentional or accidental operation of the pushbuttons used to control the adjustment device. Furthermore, this clasp has no real system for precisely guiding the translational movement of the connecting member.

CH 691 159 also presents a sliding adjustment member whose position is fixed by a screw. Such a system therefore requires a screwdriver and therefore cannot be adjusted unless one is in possession of a screwdriver that fits the screw. Considering the size of the screw, this usually requires a visit to a specialist.

Other prior clasps have length-adjusting devices using various movable racks whose position can be fixed using an immobilizing member, as described for example in U.S. Pat. No. 2,596,186. The disadvantage of such a device is that although for aesthetic reasons it is not possible to extend the rack from the ends of the clasp. The maximum length of adjustment simply cannot therefore extend to more than half the length of the clasp, which is manifestly not enough, especially for a clasp for a diving watch in particular, where the length of adjustment around the wrist with and without a diving suit must be more or less considerable, and in any event greater than half the length of a folding-arm clasp, which is itself limited by the size of the wrist.

SUMMARY OF THE INVENTION

As can be seen, none of the prior-art inventions meets the requirements of safety in maintaining the adjustment, or of ease of adjustment, while simultaneously allowing the clasp to be used like a normal clasp when it is not wished to modify the adjusted length.

The object of the present invention is to fulfill all the requirements which such a clasp must satisfy.

To this end, the present invention relates to a clasp for a band comprising at least two long arms that pivot on each other about transverse hinge pins at one of their respective longitudinal ends, a locking device for keeping the free ends of these two long arms in the folded position, transverse connecting members for connecting the long arms to the respective ends of a band, and a mechanism for adjusting the longitudinal position of the transverse connecting member connecting one of the free ends of the band to a first one of the long arms having on the one hand a sliding device comprising two tracks defining two corresponding paths extending laterally in two planes parallel to the longitudinal axis of this first long arm and integral therewith, two stops for defining the active length of the tracks, sliding elements integral with the respective ends of the transverse connecting member connecting one of the ends of the band to this first long arm, to engage with the respective tracks, and on the other hand a positioning device, of which a first part has a plurality of longitudinal positioning elements extending along this first long arm, for a length equal to the distance between the two stops, and of which the second part has an immobilizing element integral with said transverse connecting member, shaped to engage when desired with said plurality of longitudinal positioning elements; in which clasp the cross sections of each track on the one hand, and of the sliding element engaged with the latter on the other, comprise complementary adjacent surfaces, part of which intersects the transverse hinge pin of said transverse connecting member and extends in the direction of translational movement defined by the tracks, to allow said transverse connecting member to move translationally only when said plurality of positioning elements and said immobilizing element of the positioning device are not engaged with each other.

The principal advantage of the clasp of the invention is that it makes the translational guidance as precise as the guides used in precision instruments and machines. With such guidance it is possible to slide the connecting member smoothly and without sticking when adjusting the length. This is particularly important where the range of adjustment is large, as is particularly the case when it comes to an adjustable clasp for a diving watch band, which has to be able to adapt both directly to the diver's wrist and indirectly to the diving suit, which represents a difference of several centimeters around the wrist.

Advantageously, one of the two parts of the positioning device is mounted on a hinge pin extending transversely relative to the long arms of the clasp, to bring about relative movement between the plurality of positioning elements and the immobilizing element for the purposes of engaging and disengaging them with each other.

By means of this arrangement, the clasp of the invention provides an adjustment device that is completely independent of the opening and closing device, and the adjustment device can only be operated as the result of an intentional action.

BRIEF DESCRIPTION OF DRAWINGS

A number of further features and advantages of the clasp according to the invention will become apparent from the following description, which is given with the aid of the appended drawings, which illustrate, schematically and by way of example, two embodiments and one variant of the clasp of the present invention.

DETAILED DESCRIPTION OF PARTICULAR EMBODIMENTS

Figure 1:
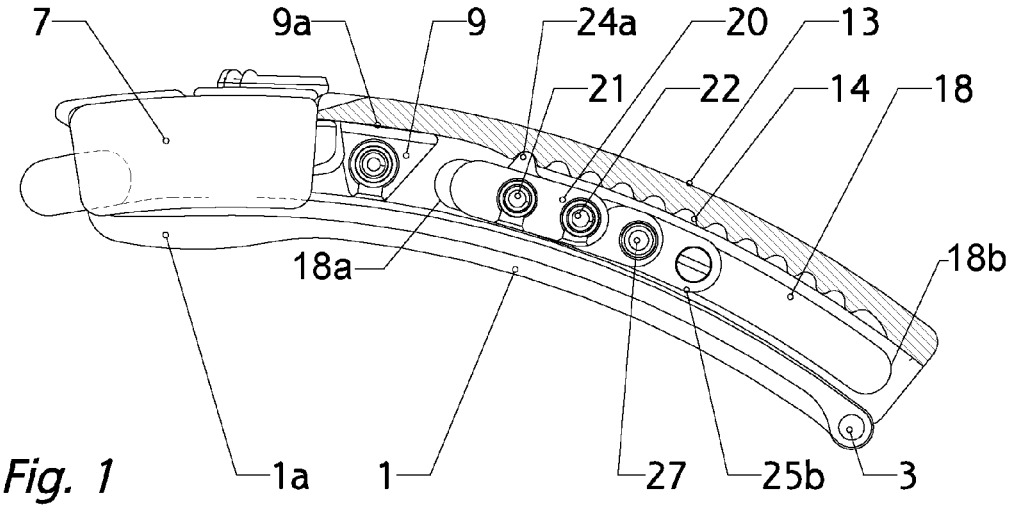
FIG. 1 is an elevation view in lateral section on I-I in FIG. 3 of the clasp according to the first embodiment in the closed position.
Figure 2:
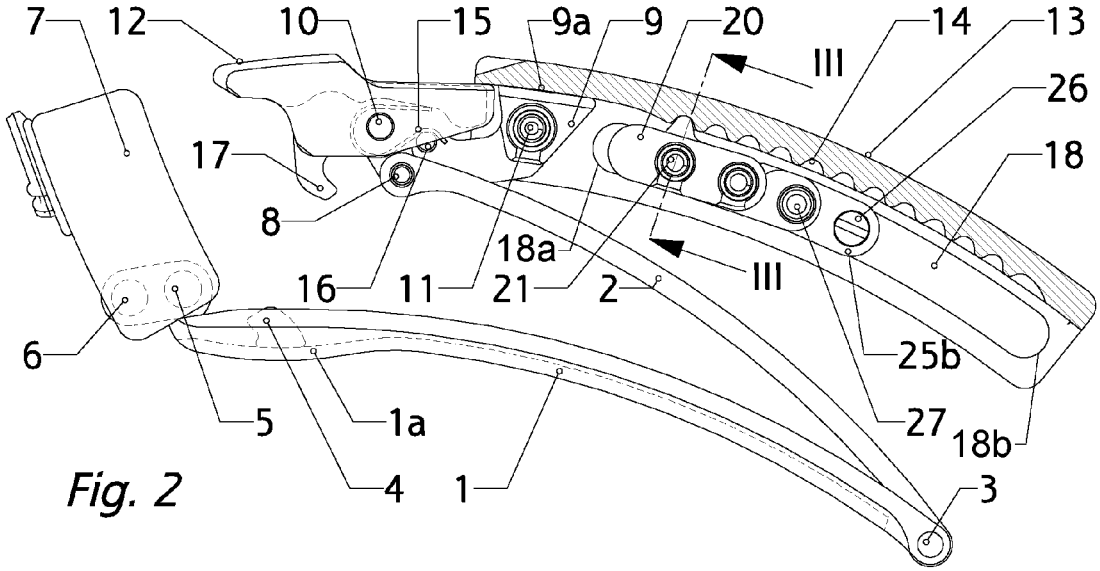
FIG. 2 is a view of FIG. 1 with the clasp in the open position.

The clasp illustrated in FIGS. 1 and 2 is a known type of clasp described in EP 1 654 950: it has two arms 1, 2 extending in the longitudinal direction of the clasp and hinged at one of their ends about a hinge pin 3. The free end of the arm 1 has a hook element 4 which takes the form of a transverse element parallel to the hinge pin 3. This hook element 4 is situated in a part la of the free end of the arm 1 which is outwardly curved. A space is provided between this hook element 4 and the bottom of this curved part 1*a* to allow a hook member to be inserted between the hook element 4 and the bottom of the curved part 1*a*, as will be explained later. This same free end is also connected to two hinge pins 5, 6 parallel to the hinge pin 3 of the arms 1, 2. One 5 of these hinge pins serves as the pivot for a locking cover 7, while the other serves as the pivot for one end of one of the halves of the band (not shown).

An assembly member 9 is hinged to the free end of the long arm 2 about the hinge pin 8 and has two other hinge pins 10 and 11. The hinge pin 10 serves as the pivot for a locking lever 12 and the hinge pin 11 serves to connect a cover or arm 13 extending in the longitudinal direction of the clasp and forming an end arm of the succession of arms 1, 2, 13 articulated with each other.

The assembly member 9 has a surface 9*a* adjacent to the inside face of the upper wall of the cover 13. This surface 9*a* is to prevent the cover 13 pivoting about the hinge pin 11. The end of this cover 13 nearest the free end of the arm 2 covers the rear end of the locking lever 12.

As can be seen in FIG. 2 in particular, one end of a spring 15 bears on a rod 16 connected to the assembly member 9 and passes around the pin 10 which hinges this assembly member 9 to the locking lever 12. The other end of this spring 15 bears against the inside face of the upper wall of the locking lever 12. As a result, this spring creates a torque on the locking lever 12 that tends to turn it in the counterclockwise direction when viewing FIGS. 1 and 2. A second spring identical to the spring 15 (not visible) passes around the hinge pin 10.

On the locking lever 12 is a locking hook 17 shaped so as to be able to engage between the locking element 4 attached to the free end of the arm 1 and the bottom of the curved part la of this arm 1, in which position it is held by the torque applied to it by the spring 15. Lifting the front part of the lever 12 so that it pivots clockwise, against the torque of the spring 15 opens the clasp.

It should be understood that the closing mechanism of the clasp is not part of the invention and can be replaced with any other appropriate mechanism.

Figure 3:
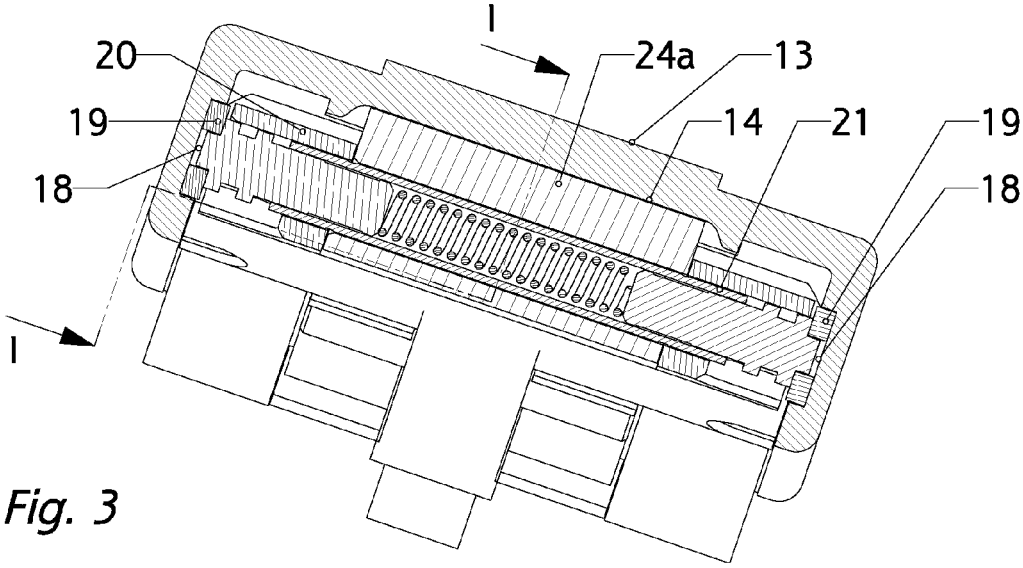
FIG. 3 is a view in section on the line III-III in FIG. 2.

In cross section, the cover 13 forms an inverted U, as illustrated in FIG. 3. The inside face of the bottom of the U of this cover has positioning teeth 14, similar to the teeth of a rack. The inside faces of the two side walls of this cover 13 each comprise a guide track 18 formed, in this example, by milling into the thickness of these side walls. Two sliding rollers 19 whose diameters both correspond to the width of one guide track 18 pivot on the respective ends of two spring bars 21, 22 which exert antagonistic lateral forces on the opposite rollers which elastically keep them in the guide tracks 18. The spring bars 21, 22 are housed in transverse passages running through a connecting member 20. This connecting member 20 is used to connect one end of the band to the cover or arm 13, as explained later. Owing to the complementary profiles of the rollers 19 and of the tracks 18 and owing to the antagonistic forces acting on the rollers 19 to keep them in the tracks 18, when the two pairs of sliding rollers 19 of the connecting member 20 are engaged in the opposite guide tracks 18, each pair of sliding rollers 19 has one degree of freedom defined by the longitudinal path of the tracks 18. the connecting member 20 connected to the two pairs of rollers 19 can therefore move only translationally, with friction only between the rollers 19 and the guide tracks 18.

Figure 4:
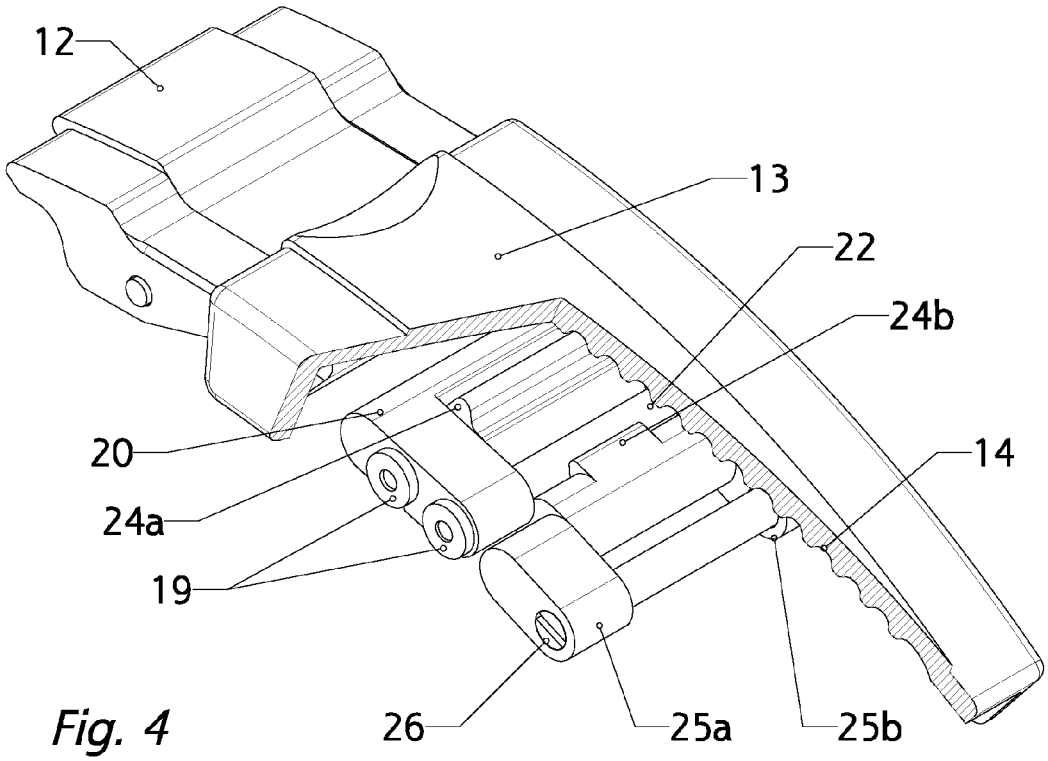
FIG. 4 is a partial perspective view of FIG. 1 with cut-away parts.

As can be seen in FIGS. 1, 3 and 4 in particular, an immobilizing element 24 pivots on the bar 21. This immobilizing element 24 has a tooth 24*a* shaped to engage between the teeth 14 on the bottom of the U of the cover 13 when the immobilizing element 24 is in the position around the bar 22 illustrated in FIGS. 1-4. The immobilizing element 24 is kept with the tooth 24*a* in this position of engagement in the teeth 14 of the rack by a nose 24*b* designed to catch elastically (by the bending of the bars 21, 22) on the bar 22, as shown in FIG. 4.

Figure 5:
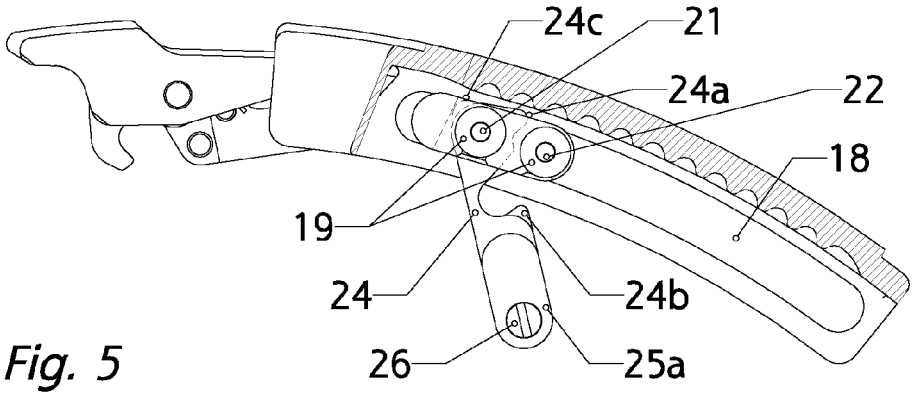
FIG. 5 is a partial view of FIG. 1 with the two parts of the positioning device disengaged.
Figure 6:
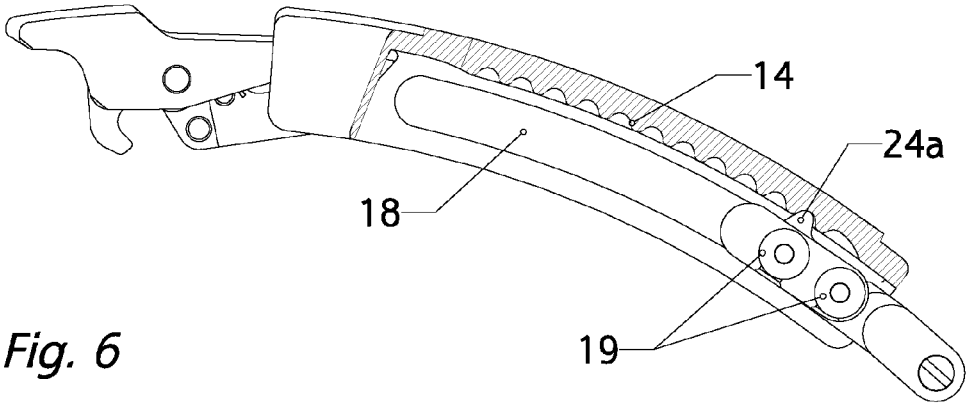
FIG. 6 is a view similar to FIG. 5 showing the band connecting member at the other end of the adjustment device.

As illustrated in FIGS. 4 and 5, the immobilizing element 24 also serves to take two side links 25*a*, 25*b* for attaching to one end of the band (not shown) using a screw 26. These two side links 25*a*, 25*b* are fixed by press fitting the respective ends of a rod 27 (FIGS. 1 and 2) into two blind holes in these side links 25*a*, 25*b*.

To disengage the tooth 24*a* of the immobilizing element 24 from the teeth 14 of the rack, the user simply pivots the side links 25*a*, 25*b* about the rod 27 to a position forming an angle with the cover 13 and pulls the band—which is extremely easy when the band is attached to the screw 26.

As soon as the tooth 24*a* is disengaged from the teeth 14 of the rack, the movable assembly formed by the connecting member 20, the parallel spring bars 21, 22, the rollers 19 and the immobilizing element 24 can be slid freely like a carriage along the guide tracks 18. The distance it can travel is limited by the ends of the milled tracks 18, which form stops 18*a* and 18*b*. The length of the rack formed by the teeth 14 is approximately equal to the length of the tracks 18. As soon as the movable assembly has reached its new position of adjustment, the user simply pivots the immobilizing element 24 in the opposite direction to snap the nose 24*b* back over the bar 22.

A retention element formed by a small projection 24*c* is advantageously arranged on one of the faces of the immobilizing element 24 in such a way as to come against the inner edge of the connecting member when the immobilizing element 24 is pivoted out of engagement with the tooth 24*a*, as shown in FIG. 5. This retention element keeps the immobilizing element in its pivoted position shown in FIG. 5 as the connecting member is slid along the tracks 18 with which the rollers 19 are in engagement so that the tooth 24*a* cannot interfere with the rack teeth 14.

As can be seen, the band can only be adjusted intentionally and in no case accidentally or by inadvertence, because it can only be adjusted after the clasp has been opened, and the nose 24*b* then has to be disengaged from the bar 22 on which it is elastically held.

Figure 7:
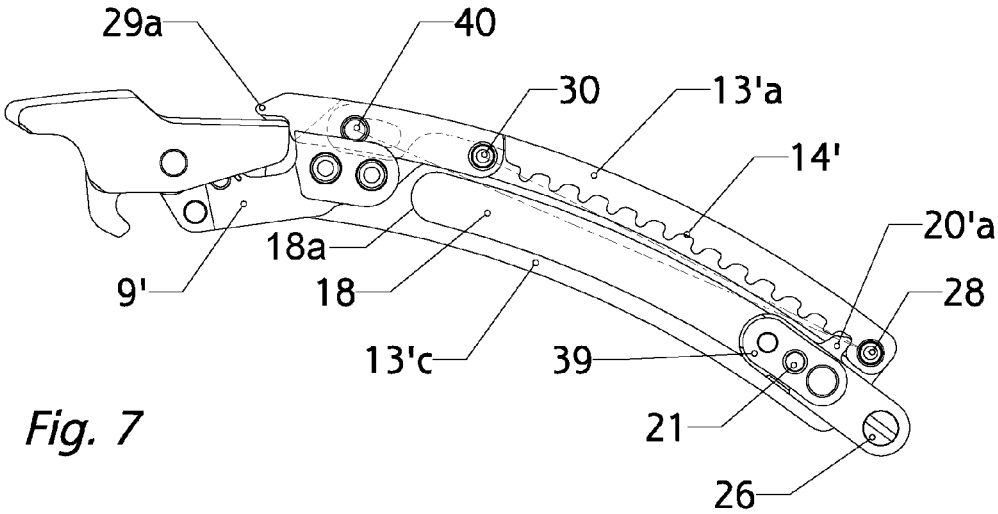
FIG. 7 is a partial view in longitudinal section similar to FIG. 5 with the two parts of the positioning device engaged, of the second embodiment of the clasp of the invention.
Figure 8:
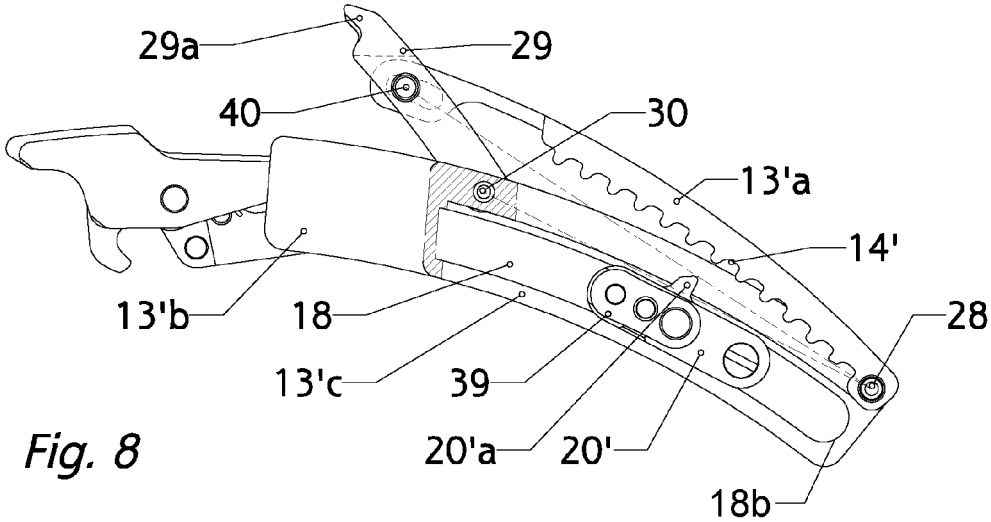
FIG. 8 is a view similar to FIG. 7 with the two parts of the positioning device disengaged.
Figure 9:
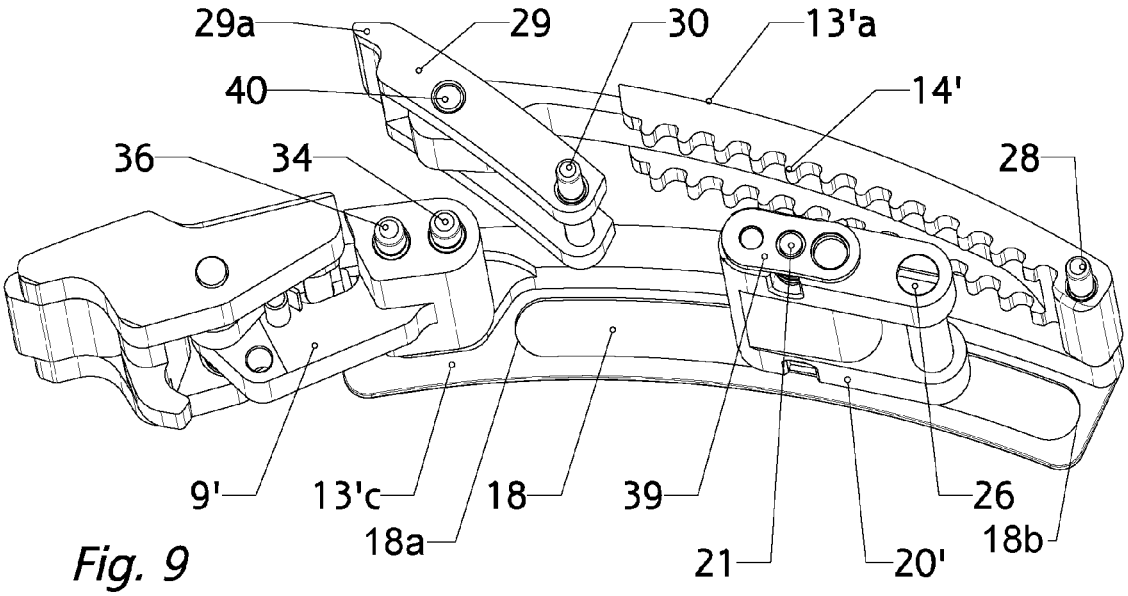
FIG. 9 is a perspective view of FIG. 8 without the front part 13'*b* of the cover to improve visibility.

The second embodiment, illustrated in FIGS. 7, 8 and 9, differs from the first only in that the tooth 20'*a* is not now integral with an immobilizing element pivoting on the bar 21, the immobilizing element 20'*a* being stationary, and the bar 21 extends through it. To engage and disengage the immobilizing tooth 20'*a* relative to the teeth 14' of the rack, the rack is on a flap 13'*a* independent of the bottom of the U of the cover 13' which is formed by two parallel parts, a front part 13'*b* and a rear part 13'*c* separated from one another by the breadth of the flap 13'*a* and joined by hinge pins, including a transverse hinge pin 28 on which one end of the flap 13'*a* pivots.

The other end of the flap 13'*a* is hinged about a transverse hinge pin 40 to a control lever 29 which has one end pivoting on the cover 13, about a transverse hinge pin 30. The other end 29*a* of this control lever 29 projects, when the adjacent end of the cover 13' is down (FIG. 7), to provide a means of lifting it when the user wishes to disengage the teeth 14' of its rack from the fixed tooth 20'*a* in order to allow the movable assembly 20', 21 to be slid along the guide tracks 18. Afterwards, the user simply pushes the flap 13'*a* back down to engage the fixed tooth 20'*a* with one of the teeth 14' of the rack integral with the flap 13'*a*.

The flap 13'*a* and the control lever 29 form a toggle joint, so that when the flap 13'*a* is moved away from its position shown in FIG. 8 to the shut position shown in FIG. 7 it comes under tension, while the control lever 29 comes under compression because of the different path of the hinge pin 40 pivoting simultaneously about the hinge pin 28 and about the hinge pin 30. As a result, depending on whether the hinge pin 40 is on one side or the other side of the line L connecting the transverse hinge pin 28 to the hinge pin 30, the stresses acting on the flap 13'*a* and on the control lever 29 exert two torques of opposite directions which keep the flap 13'*a* open, or closed, respectively, as illustrated in FIGS. 8 and 7, respectively, thus forming a bistable system on the two sides of the line L.

The advantage of this embodiment is that it allows the length of the band to be adjusted without removing the watch from the wrist. It may also be pointed out that in the shut position, the end 29*a* of the control lever 29 which projects from the end of the cover 13' is covered by the locking cover 7 illustrated in FIGS. 1 and 2. There is therefore no risk that the control lever 29 will be operated accidentally.

Figure 10:
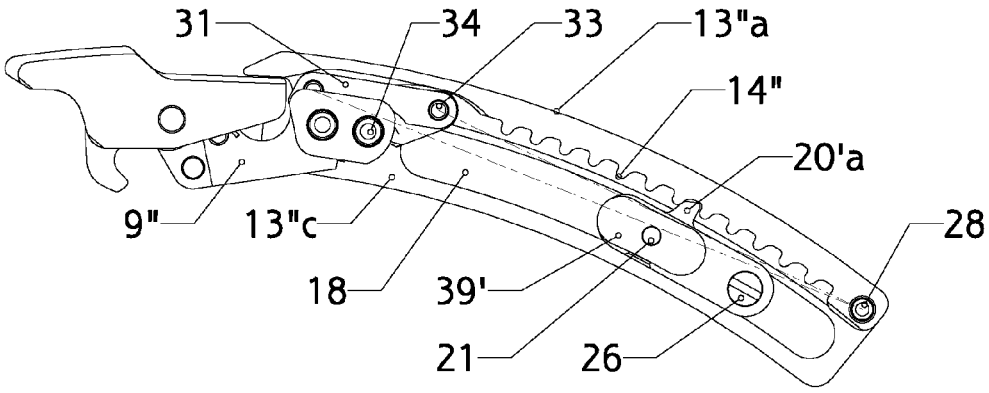
FIG. 10 is a view similar to FIG. 7, showing a variant of the second embodiment.
Figure 11:
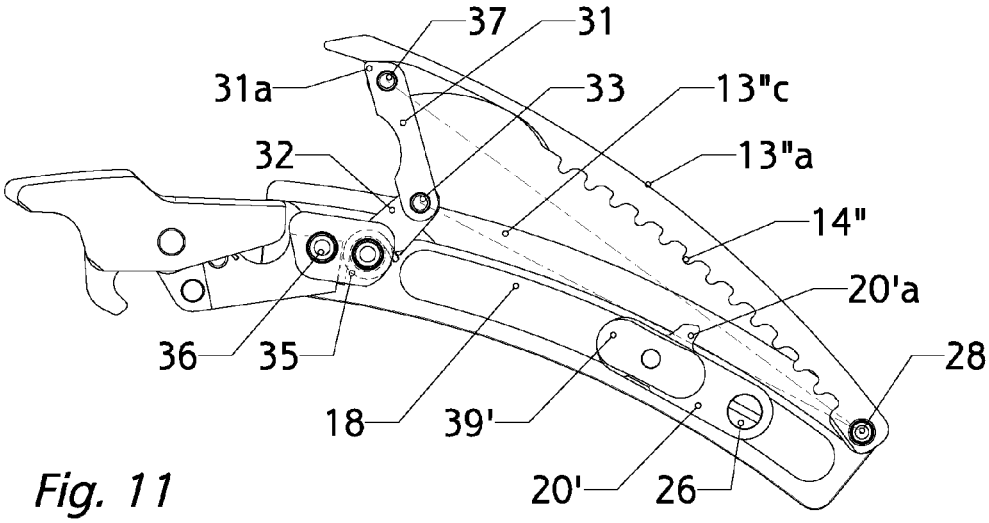
FIG. 11 is a view similar to FIG. 10 with the two parts of the positioning device disengaged.
Figure 12:
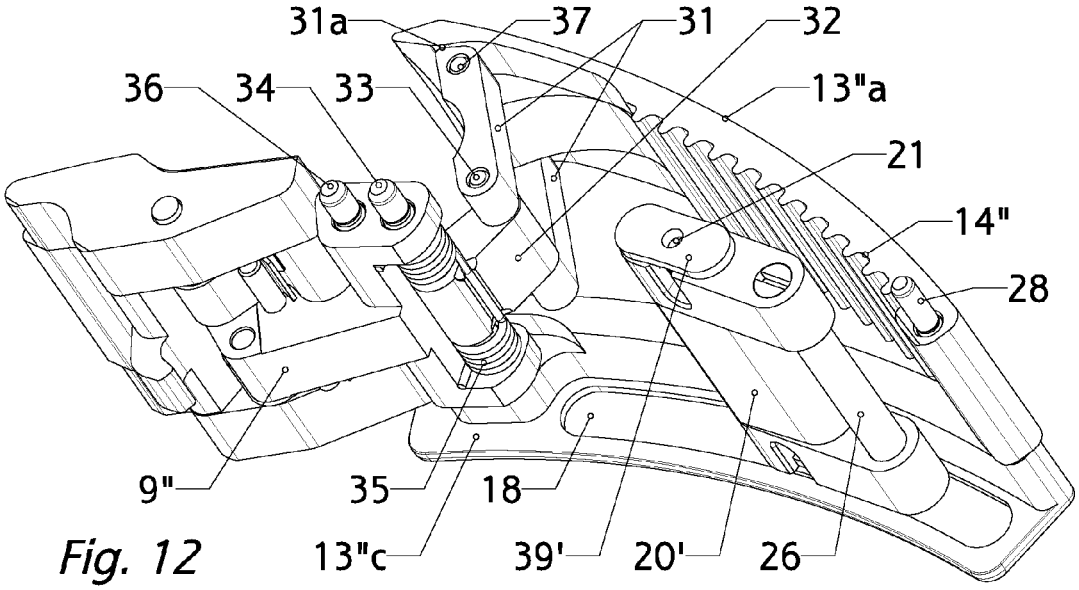
FIG. 12 is a perspective view of FIG. 11 without the front part 13"*b* of the cover to improve visibility.

In the variant shown in FIGS. 10-12, the control lever 29 is replaced with a toggle joint comprising two arms 31, 32 articulated together at one end of each about a hinge pin 33. Arm 31 is actually two arms. The second end of the arm 32 pivots about a transverse spindle 34 connected to the two halves 13"*b*, 13"*c* of the cover 13". A prestressed helical spring 35 is mounted on the transverse spindle 34 and applies a counterclockwise torque to the arm 32. The second end of the double arm 31 is shaped into a stop 31*a* designed to bear against the lower face of the flap 13"*a*. This second end of the arm 31 pivots on the free end of the flap 13*a* via a transverse hinge pin 37.

As can be seen by comparing the respective positions of the arms 31, 32 in FIGS. 10-12, as the hinge pin 37 moves from the flap-out position (FIG. 11) to its shut position (FIG. 10), this hinge pin 37 passes through a point of equilibrium relative to the hinge pin 33 of the toggle joint, so that the counterclockwise torque of the spring 35 on the arm 32 keeps the flap 13"*a* open once the hinge pin 37 has passed the position of equilibrium relative to the hinge pin 33, while this same torque closes the flap 13"*a* and keeps it closed once the hinge pin 37 has passed this position of equilibrium in the opposite direction. In view of the rigidity of the arms 31, 32 of the toggle joint, the system is able to pass through the position of equilibrium because of the helical spring 35 mounted on the transverse hinge pin 34. Keeping the flap 13"*a* open also allows the movable assembly 20' to slide freely in either direction all the way along the tracks 18.

As will also be seen, in this second embodiment, the rollers 19 are replaced with sliding shoes 39, 39' engaged in guide tracks 18 formed in the inside faces of the two side walls of the cover 13', 13". The sliding shoes 39, 39, are made of a friction-reducing material that is also wear-resistant. They have a slightly arched profile which permits a precise fit in the respective guide tracks 18. These shoes may be either in one piece made of a material with a low coefficient of friction, such as a plastic, or formed essentially from metal covered with a wear-resistant material with a low coefficient of friction.

Naturally, it is perfectly possible to replace the rollers 19 of the first embodiment with the sliding shoes 39, 39' and vice versa. The forces of friction on the sliding shoes 39, 39' can be adjusted through the lateral forces applied to these sliding shoes 39, 39' by the spring bar 21.

The invention claimed is:

1. A clasp for a band, said clasp comprising:

a succession of at least two long arms that are articulated with each other, a locking device for keeping the long arms in a position folded against each other in a locked position of the locking device, transverse connecting members for connecting two of the long arms forming respective ends of the succession of the long arms to respective free ends of a band, and a mechanism for adjusting a longitudinal position of the transverse connecting member connecting one of the free ends of the band to a first one of the two long arms forming the ends of the succession of the long arms, wherein said mechanism comprises (i) a sliding device comprising:

two tracks defining two corresponding paths extending laterally in two planes parallel to the longitudinal axis of the first long arm, two stops defining an active length of the tracks, sliding elements integral with respective lateral ends of the transverse connecting member, wherein the sliding elements engage with the respective tracks so as to allow the transverse connecting member to move translationally along the tracks but not rotationally with respect to the tracks, and (ii) a positioning device comprising:

a first part including a plurality of longitudinal positioning elements extending along the first long arm, for a length approximately equal to the distance between the two stops, and a second part including an immobilizing element integral with said transverse connecting member, shaped to engage when desired with said plurality of longitudinal positioning elements, wherein a transversally oriented portion of each respective track and a transversally oriented portion of the sliding element engaged with the respective track comprise complementary adjacent surfaces extending in the direction of translational movement defined by the tracks, so as to prevent the transverse connecting member from moving transversally with respect to the tracks, so that said transverse connecting member is allowed to move translationally only along the tracks when said plurality of positioning elements and said immobilizing element of the positioning device are not engaged with each other, and said transverse connecting member is immobilized with respect to said tracks when said plurality of positioning elements and said immobilizing element are engaged with each other.

2. The clasp as claimed in claim 1, in which one of the two parts of the positioning device is mounted on a hinge pin extending transversely relative to said long arms to bring about relative movement between the plurality of positioning elements and the immobilizing element for the purposes of engaging and disengaging them with each other.

3. The clasp as claimed in claim 2, in which said part of the positioning device mounted on the hinge pin extending transversely relative to said long arms has a retention element for keeping the immobilizing element of said part disengaged from the positioning elements.

4. The clasp as claimed in claim 3, in which said sliding elements are put in engagement with said guide tracks by at least one elastic member for applying opposing lateral forces to said sliding elements engaged with said respective guide tracks.

5. The clasp as claimed in claim 2, in which said sliding elements are put in engagement with said guide tracks by at least one elastic member for applying opposing lateral forces to said sliding elements engaged with said respective guide tracks.

6. The clasp as claimed in claim 1, in which the first long arm has a cross section in the form of an inverted U, said plurality of positioning elements being integral with at least one portion of the wall connecting the two arms of this U section, one end of said wall portion adjacent to one end of the first long arm being integral with a transverse hinge pin, and the other end of said wall portion being connected to the first long arm by a toggle joint.

7. The clasp as claimed in claim 6, in which a return spring is fitted to the toggle joint, this spring tending to keep said wall portion either at two alternative positions on either side of a position of equilibrium of the toggle joint, namely a shut position in which said plurality of positioning elements is engaged with said immobilizing element, and an out position in which the two parts of the positioning device are separated from each other.

8. The clasp as claimed in claim 7, in which the corresponding tracks are formed in a thickness of the side walls of the long arm whose cross section is an inverted U.

9. The clasp as claimed in claim 8, in which the sliding elements comprise sliding shoes engaged with each of the corresponding tracks.

10. The clasp as claimed in claim 8, in which the sliding elements comprise sliding rollers engaged with each of said corresponding tracks.

11. The clasp as claimed in claim 8, in which said sliding elements are put in engagement with said guide tracks by at least one elastic member for applying opposing lateral forces to said sliding elements engaged with said respective guide tracks.

12. The clasp as claimed in claim 7, in which said sliding elements are put in engagement with said guide tracks by at least one elastic member for applying opposing lateral forces to said sliding elements engaged with said respective guide tracks.

13. The clasp as claimed claim 6, in which the corresponding tracks are formed in the thickness of the side walls of the long arm whose cross section is an inverted U.

14. The clasp as claimed in claim 13, in which the sliding elements comprise sliding shoes engaged with each of the corresponding tracks.

15. The clasp as claimed in claim 14, in which said sliding elements are put in engagement with said guide tracks by at least one elastic member for applying opposing lateral forces to said sliding elements engaged with said respective guide tracks.

16. The clasp as claimed in claim 13, in which the sliding elements comprise sliding rollers engaged with each of said corresponding tracks.

17. The clasp as claimed in claim 16, in which said sliding elements are put in engagement with said guide tracks by at least one elastic member for applying opposing lateral forces to said sliding elements engaged with said respective guide tracks.

18. The clasp as claimed in claim 13, in which said sliding elements are put in engagement with said guide tracks by at least one elastic member for applying opposing lateral forces to said sliding elements engaged with said respective guide tracks.

19. The clasp as claimed in claim 6, in which said sliding elements are put in engagement with said guide tracks by at least one elastic member for applying opposing lateral forces to said sliding elements engaged with said respective guide tracks.

20. The clasp as claimed in claim 1, in which said sliding elements are put in engagement with said guide tracks by at least one elastic member for applying opposing lateral forces to said sliding elements engaged with said respective guide tracks.

21. The clasp as claimed in claim 1, wherein the first long arm has two parallel lateral walls, the tracks being provided in internal faces of these respective lateral walls, within a thickness of these walls, and wherein the sliding elements have contours complementary to those of the tracks, and are conformed to ensure on each side of the connecting member a contact with the track at contact points that are longitudinally spaced, so that the movement of the sliding elements has a single degree of freedom.

22. A clasp for a band, said clasp comprising:

a succession of at least three long arms that are articulated with each other, a locking device keeping the long arms in a position folded against each other in a locked position of the locking device, transverse connecting members for connecting two of the long arms forming respective ends of the succession of the long arms to respective free ends of a band, and a mechanism for adjusting a longitudinal position of the transverse connecting member connecting one of the free ends of the band to a first one of the two long arms forming the ends of the succession of the long arms, wherein said mechanism comprises (i) a sliding device comprising:

two tracks integral with the first long arm, the two tracks defining two corresponding paths extending laterally in two planes parallel to the longitudinal axis of the first long arm, two stops defining an active length of the tracks, sliding elements integral with respective lateral ends of the transverse connecting member, wherein the sliding elements engage with the respective tracks so as to allow the transverse connecting member to move translationally along the tracks, and (ii) a positioning device comprising:

a first part including a plurality of longitudinal positioning elements extending along the first long arm, for a length approximately equal to the distance between the two stops, and a second part including an immobilizing element integral with said transverse connecting member, shaped to engage when desired with said plurality of longitudinal positioning elements, wherein a transversally oriented portion of each respective track and a transversally oriented portion of the sliding element engaged with the respective track comprise complementary adjacent surfaces extending in the direction of translational movement defined by the tracks, so as to prevent the transverse connecting member from moving transversally with respect to the tracks, so that said transverse connecting member is allowed to move translationally along the tracks when said plurality of positioning elements and said immobilizing element of the positioning device are not engaged with each other, and said transverse connecting member is immobilized with respect to said tracks when said plurality of positioning elements and said immobilizing element are engaged with each other.

23. A clasp for a band, said clasp comprising:

a succession of at least two long arms that pivot on each other at one of their respective longitudinal ends, a locking device keeping the long arms in a position folded against each other in a locked position of the locking device, a first transverse connecting member for connecting a first end long arm forming a first end of the succession of the long arms to a first free end of a band, a cover articulated on a second end long arm forming a second end of the succession of the long arms, a second transverse connecting member for connecting the cover to a second free end of the band, and a mechanism for adjusting a longitudinal position of the second transverse connecting member connecting the second free end of the band to the cover, wherein said mechanism comprises (i) a sliding device comprising:

two tracks integral with the cover, the two tracks defining two corresponding paths extending laterally in two planes parallel to the longitudinal axis of the cover, two stops defining an active length of the tracks, sliding elements integral with respective lateral ends of the second transverse connecting member, wherein the sliding elements engage with the respective tracks so as to allow the transverse connecting member to move translationally along the tracks, and (ii) a positioning device comprising:

a first part including a plurality of longitudinal positioning elements extending along the cover, for a length approximately equal to the distance between the two stops, and a second part including an immobilizing element integral with said second transverse connecting member, shaped to engage when desired with said plurality of longitudinal positioning elements, wherein a transversally oriented portion of each respective track and a transversally oriented portion of the sliding element engaged with the respective track comprise complementary adjacent surfaces extending in the direction of translational movement defined by the tracks, so as to prevent the second transverse connecting member from moving transversally with respect to the tracks, so that said second transverse connecting member is allowed to move translationally along the tracks when said plurality of positioning elements and said immobilizing element of the positioning device are not engaged with each other, and said second transverse connecting member is immobilized with respect to said tracks when said plurality of positioning elements and said immobilizing element are engaged with each other.

* * * * *